US005738355A

United States Patent [19]

Gibson

[11] Patent Number: 5,738,355

[45] Date of Patent: Apr. 14, 1998

[54] GAME

[76] Inventor: Kevin D. Gibson, R.R. #6, Site 666 C-1, Courtenay, British Columbia, Canada, V9N 8H9

[21] Appl. No.: 802,414

[22] Filed: Feb. 18, 1997

[51] Int. Cl.[6] ..... A63F 9/00

[52] U.S. Cl. ..... 273/457

[58] Field of Search ..... 273/138.5, 456, 273/457

[56] References Cited

U.S. PATENT DOCUMENTS

| | | | |
|---|---|---|---|
| 947,124 | 1/1910 | Renner | 273/457 X |
| 3,734,502 | 5/1973 | Bolton | 273/456 X |
| 3,829,088 | 8/1974 | Pahlas | 273/456 X |
| 3,843,125 | 10/1974 | Loose et al. | 273/456 X |
| 4,032,141 | 6/1977 | Tanimura | 273/457 |
| 4,136,872 | 1/1979 | Matsumoto | 273/457 X |
| 4,359,224 | 11/1982 | Nottingham et al. | 273/115 |
| 4,632,397 | 12/1986 | Rivkin | 273/457 X |
| 5,022,654 | 6/1991 | Berger | 273/457 X |
| 5,100,156 | 3/1992 | Mayne | 273/457 |
| 5,328,173 | 7/1994 | Stern | 273/457 X |

FOREIGN PATENT DOCUMENTS 1160258 1/1980 Canada .

*Primary Examiner*—William H. Grieb
*Attorney, Agent, or Firm*—Long and Cameron

[57] ABSTRACT

A game has a pair parallel walls defining a space therebetween, at least one of the walls being transparent to permit viewing of the space from the exterior of the game, and a liquid-light seal around the space, with a liquid retained in the space by the seal. Buoyant balls immersed in the liquid include a ferrous material, and a retainer extends partially across a lower portion of the space for releasably retaining the balls. A magnet at the exterior of the space is manipulable for displacing the balls from beneath the retainer; and ball receptacles located above the retainer each have a downwardly facing ball reception opening dimensioned to receive the balls therein as the balls rise buoyantly through the space on release of the balls by the magnet.

14 Claims, 10 Drawing Sheets

GAME

BACKGROUND OF THE INVENTION

1. Field of the Invention

The present invention relates to games and, more particularly, to games employing buoyant objects immersed in a liquid.

2. Description of the Related Art

It has previously been proposed to make a game which includes buoyant objects in a liquid. For example, U.S. Pat. No. 4,359,224 shows a game having a pair of spaced walls defining a chamber containing a fluid, with a target, and a pair of balls, one of which has a lower specific gravity than the fluid, and the other of which has a higher specific gravity, the walls being transparent. This requires the entire game to be held and manipulated in various directions in order to displace the balls to their required locations.

U.S. Pat. No. 5,022,654 discloses a game of chance in which a container filled with a liquid contains a die and an obstacle. The die is less dense than the liquid, and the obstacle is more dense than the liquid.

U.S. Pat. No. 4,632,397 shows an amusement chance device employing magnetic game pieces having a specific gravity greater than a liquid a container, with indicia on facets of the game pieces, and a magnet at the exterior of the container for use in retaining and releasing the game pieces.

U.S. Pat. No. 3,843,125 shows a game in which magnetic balls floating beneath a transparent plate can be attracted by tossing a magnetic piece onto the plate.

BRIEF SUMMARY OF THE INVENTION

According to the present invention, a game comprises a pair of parallel vertical walls defining between them a space containing a liquid, with a liquid-tight seal extending around the peripheries of the walls for sealing the space. At least one of the walls is transparent, to allow the space to be viewed from the exterior of the game, and a plurality of balls, which are buoyant in the liquid and which contain a ferrous material, are provided in the space. A magnet at the exterior of the space can be used to attract and displace the balls to a position at a lower portion of the space, beneath a retainer extending partially across the space for releasably retaining the balls. On release from beneath the retainer by use of the magnet, the balls, due to their buoyancy, rise through the space, and a plurality of ball receptacles are provided within the space above the retainer, the receptacles having downwardly facing openings dimensioned to receive the balls therein as the balls rise through the space.

In a first embodiment of the invention, the receptacles are each formed by a pair of horizontally spaced, elongate, generally vertically extending ball guides which are spaced apart from one another to define the ball reception openings.

In another embodiment of the invention, each ball receptacle comprises a fixed elongate generally vertically extending first ball guide and a second ball guide which is spaced laterally from the first ball guide. The second ball guide is formed with a catch extending towards the first ball guide for releasably retaining one of the balls beneath the catch, and also includes a trip arm projecting in a direction away from the first ball guide for causing pivotation of the second ball guide, to release the retained ball, in response to rising of another ball into contact with the trip arm.

The ball receptacles are arranged in groups in which the receptacles are spaced-apart from one another horizontally by gaps, and the receptacles of each group, other than a lowermost one of the groups, are disposed vertically above the gaps of an underlying one of the groups for catching balls which rise through such gaps.

BRIEF DESCRIPTION OF THE DRAWINGS

Further features and advantages of the present invention will be more readily apparent from the following description of preferred embodiments thereof given, by way example, with reference to the accompanying drawings, in which.

DESCRIPTION OF THE PREFERRED EMBODIMENTS

Figure 1:
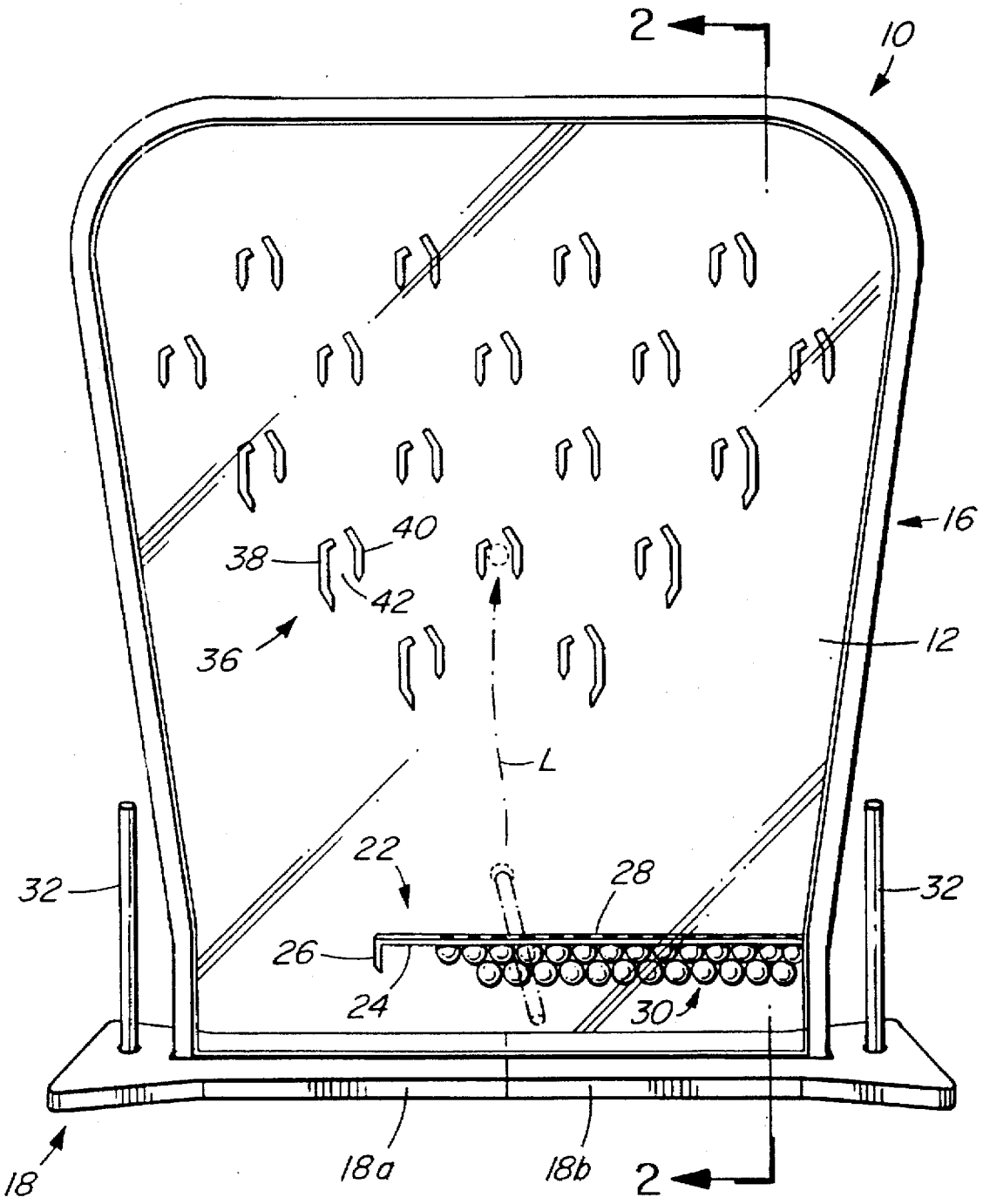
FIG. 1 shows a view in front elevation of a game according to a first embodiment of the invention.
Figure 2:
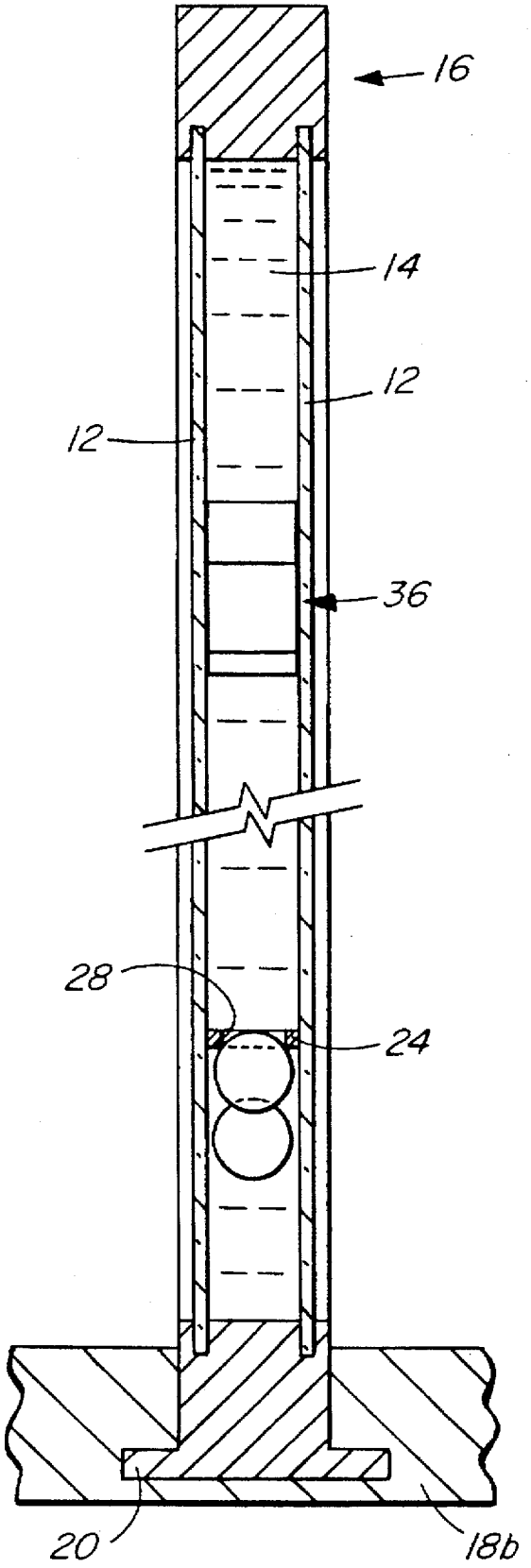
FIG. 2 shows a broken-away view taken in cross-section along the line 2—2 of FIG. 1.

In FIGS. 1 and 2 of the accompanying drawings, there is illustrated a game indicated generally by reference numeral 10 which comprises a pair of transparent walls 12, which extend vertically and parallel to one another and which define therebetween a space containing a liquid 14. The walls 12 are made of transparent plastic, and are secured together by a frame indicated generally by reference numeral 16, which extends around the peripheries of the walls 12 and which forms a liquid-tight seal around the space between the walls 12 for retaining the liquid 14.

The frame 16, and therewith the walls 12, are supported on a base indicated generally by reference numeral 18, which is formed in two separate halves 18*a* and 18*b*, which are shaped for sliding engagement with flanges 20 at the bottom of the frame 16 for releasably securing the base 18 to the frame 16 so as to hold the walls 12 in vertical positions.

Between the walls 12, at a lower portion of the space between the walls 12, a ball retainer indicated generally by reference numeral 22 extends horizontally partly across this space.

The ball retainer 22 is made of plastic material and comprises a straight, horizontally extending strip-shaped portion 24, which extends between and in contact with the mutually opposed faces of the walls 12 as shown in FIG. 2, and which extends from the frame 16 at one side of the game, as shown in FIG. 1, and a vertically downwardly extending arm 26 at an innermost end of the strip 24. The strip 24 is formed with a plurality of holes 28 to allow air, which would otherwise be trapped beneath the retainer 22, to rise through the retainer strip 24.

The holes 28 of the retainer 22 serve to releasably retain a plurality of balls indicated generally by reference numeral 30 in the lower portion of the space between the walls 12. The balls 30 are made of plastic material and are buoyant in the liquid 14, and also contain a ferrous material, as described in greater detail below with reference to FIG. 14.

Figure 3:
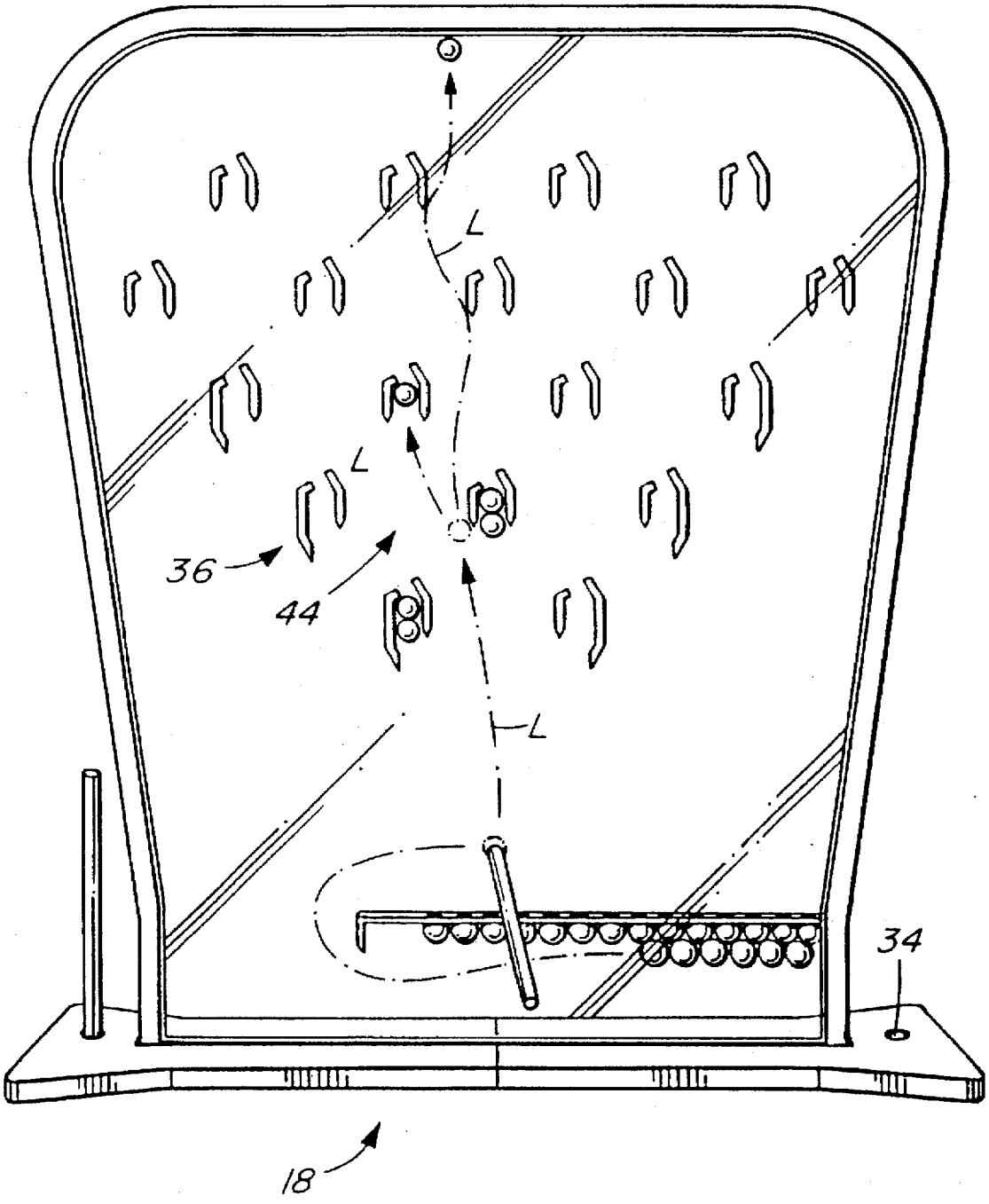
FIG. 3 shows a view similar to that of FIG. 1 but with the game in use.

At the exterior of the game 10, there are provided a pair of wands 32, which can be releasably stored in cylindrical openings 34 (FIG. 3) in the base 18. The wands 32 are made of cylindrical rods of plastic material, which are each drilled to accept a cylindrical magnet, as also described below in greater detail with reference to FIG. 14. By manipulation of one of the rods 32, as illustrated in FIG. 3, one of the balls 30 can be attracted by the magnet and thereby moved laterally from the retainer 22, around the underside of the arm 26, and then located, at a height beyond the retainer 22, in any position across the width of the game. On withdrawal of the wand 32 from this ball, the ball will then to rise upwardly through the liquid 14, due to the buoyancy of the ball.

Above the retainer 22, there are provided a number of ball receptacles indicated generally by reference numerals 36. Each ball receptacle 36 comprises a pair of ball guides in the form of generally vertically extending, elongate members 38 and 40 of plastic material, which are spaced-apart laterally of one another to define therebetween an opening 42.

The opening 42 is upwardly and downwardly open, and is dimensioned to receive therein the balls 30. More particularly, and with reference to FIG. 3, the opening 42 is dimensioned to receive and retain therein a pair of the balls, with one of the pair being located on top of the other and with the lowermost ball protruding downwardly from the opening 42 by an amount sufficient to deflect any third ball, which rises; upwardly into contact with this lowermost ball, laterally of the respective ball receptacle. In FIG. 3, possible paths of upward movement of one of the balls 30 are indicated by chain-dot lines L.

As illustrated in FIGS. 1 and 3, the ball receptacles 36 are arranged in groups, and each group comprises a horizonal row of the ball receptacles 36 separated from one another by gaps, one of which is indicated generally by reference numeral 44 in FIG. 3. Apart from the lowermost group or row of receptacles 36, the receptacles of each group are located above the gaps 44 of the next underlying group. Consequently, when a pair of balls have been trapped in one of the receptacles 36, as illustrated in FIG. 3, and a third ball is deflected laterally of that receptacle by the lowermost one of the pair of trapped balls, as described above, then this third ball rises through the adjacent gap 44 and can therefore become trapped in an overlying one of the receptacles 36. However, as also illustrated by the chain-dot lines L of FIG. 3, this third ball may miss being trapped by any of the overlying receptacles 36 and may meander upwardly through the gaps between the receptacles 36 to the top of the game, beneath the uppermost portion of the frame 16.

The balls 30 comprise at least two sets of balls, and the balls of each set are of different colours from those of the other set or sets, so that at least two competitors can play the game in competition with one another.

Figure 4:
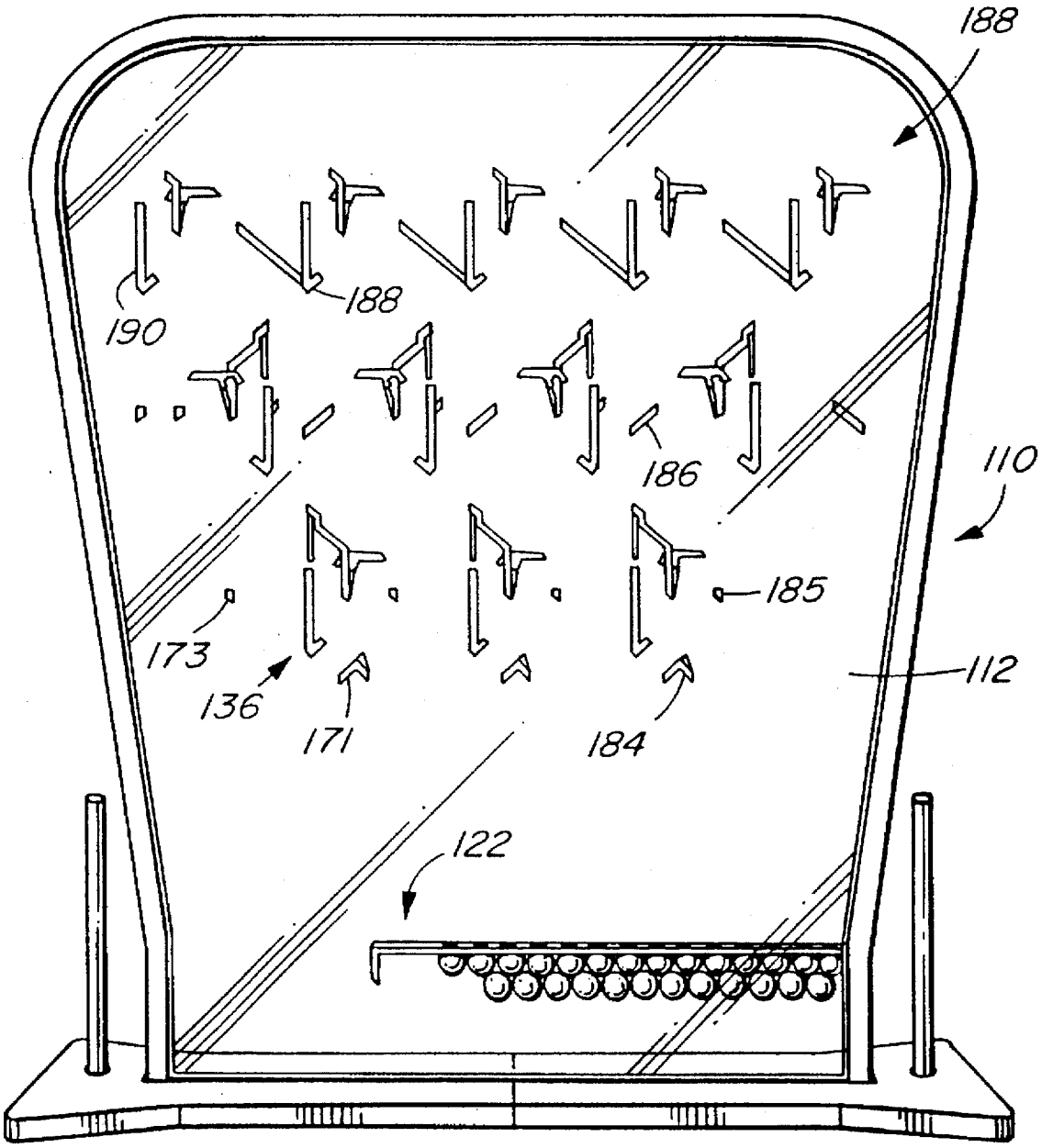
FIG. 4 shows a view in front elevation of a game according to a second embodiment of the present invention.

FIG. 4 shows a modification of the game of FIGS. 1, 2, or 3. For convenience, parts of the game shown in FIG. 4 which are similar to corresponding parts of the game shown in FIGS. 1, 2 or 3 are indicated by corresponding reference numerals, increased by 100.

Like the game 10, game 110 of FIG. 4 has a pair of parallel, vertical, spaced-apart, transparent walls, one of which is indicated by reference numeral 112, which define therebetween a space containing a liquid in which balls 130 are immersed, the balls 130 being buoyant and containing ferrous material, like the balls 30 of FIG. 1, and releasably retained beneath a retainer indicated by reference numeral 122, which is similar to the retainer 22.

Figure 7:
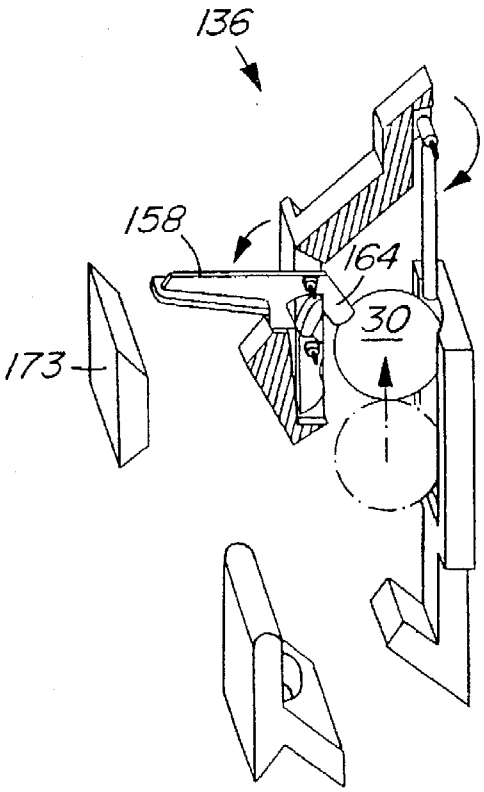
FIGS. 5 to 7 show views in perspective, from the rear and partly broken-away in cross-section, of components of the game of FIG. 4 in three different stages of operation.
Figure 6:
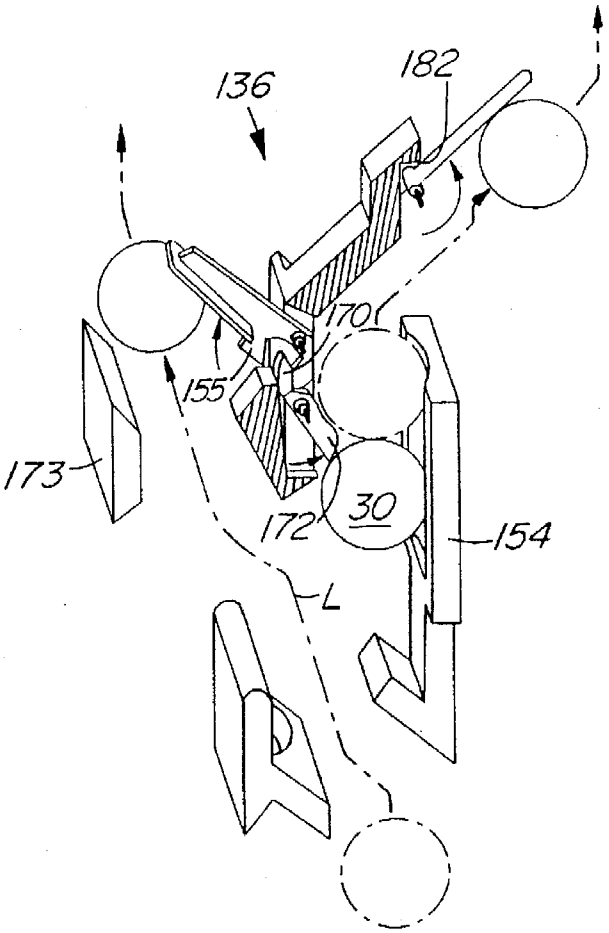
Figure 5:
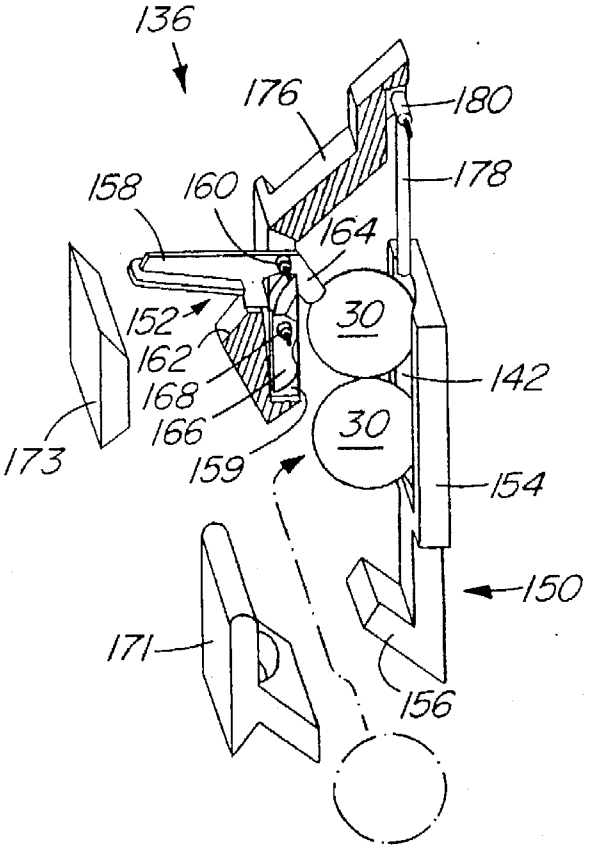

In the embodiment of FIG. 4, however, the receptacles 36 of FIG. 1 are replaced by different receptacles, one of which is indicated generally by reference numeral 136 in FIG. 4 and is illustrated in greater detail in FIG. 5, 6, and 7. With reference to FIG. 5, the receptacle 136 illustrated therein comprises a first ball guide indicated generally by reference numeral 150, and a second ball guide indicated by reference numeral 152.

The first ball guide 150 is fixed to the two transparent walls of the game 110, and comprises a straight, vertical portion 154 and, at a lower end of the vertical portion 154, an inclined portion 156, which extends upwardly at an inclination towards the second ball guide 152 for deflecting balls into a gap or opening 142 defined by and between the two ball guides 150 and 152.

The second ball guide 152 is provided with a trip arm 158, which is located in a recess 159 in the second ball guide 152 and which is pivotable about a pivot 160. The trip arm 158 which has a projection 155 which normally rests under gravity on an arm 166 forming part of the second ball guide 152. The trip arm 158 has, at one end thereof, a catch 164.

Beneath the trip arm 158, a further catch 166 is pivotally secured by a pivot 168 to the second bal guide 152. The catch 166 has an upper end 170 in sliding engagement with the catch 164 and a lower end 172 for retaining the next or succeeding ball in the gap 142, as described in greater detail below.

As can be seen from FIG. 5, the opening 142 is dimensioned to receive two of the balls 30 at a time therein with the lowermost ball 30 protruding downwardly from the gap 142 for deflecting any third ball 30 laterally of the receptacle 136, as illustrated in FIG. 6. Also as each ball 30 rises past the included portion 156 of the ball guide 150, its upward path is confirmed by the included portion 156 and a ball guide 171.

When the third ball, rising past the opening 142 as illustrated in FIG. 6 and confirmed by further ball guide 173, contacts the trip arm 158, as also illustrated in FIG. 6, and the trip arm 158 is thereby pivoted in a clockwise direction, so that the catch 164 releases the uppermost one of the balls 30 in the opening 142, which is then free to rise upwardly from the opening 142. Simultaneously, the catch 164 slidably deflects an upper end 170 of the lower catch 166, and a lower end 172 of the lower catch 166 is thereby pivoted in an anti-clockwise direction, as viewed in FIG. 6, so as to be displaced into retaining engagement with the second ball 30 in the opening 154.

The second ball guide 152 also includes an upper arm 176, which extends upwardly at an inclination above the opening 142. At the upper end of the arm 176, an elongate ball deflector 178 is secured by a pivot 180. As can be seen from FIG. 5, the ball deflector 178 normally depends vertically, under gravity, from the pivot 180. However, when one of the balls 30 is released from the opening 142 and rises upwardly along the ball guide arm 176, this ball pivots the ball deflector 178 in an anti-clockwise direction into the position in which it is shown in FIG. 6. Such pivotation is limited by an abutment portion 182 of the ball guide arm 176. The ball deflector 178 thereby serves to deflect the rising ball laterally from the respective ball receptacle 136. When this ball has risen above the upper end of the ball deflector 178, the latter again pivots downwardly, under gravity, into the position in which it is shown in FIG. 7. Also, the trip arm 158 pivots downwardly under gravity, in an anti-clockwise direction, about the pivot 160 into the position in which it is shown in FIG. 7, and in which the catch 164 again becomes operative to retain the next ball 30 in the opening 142. The projection 155 on the swing arm 158 pivots the lower catch 166 back into the position in which it is shown in FIG. 7.

As can be seen in FIGS. 4 through 7, further ball deflectors 186 are provided in the vicinity of the second row of receptacles 136 for deflecting the balls. Also, an upper row of receptacles, indicated generally by reference numeral 188, with the arm 176 and deflector 178 omitted and with further ball guides 188 and 190, is provided at the upper portion of the game 110.

Figure 8:
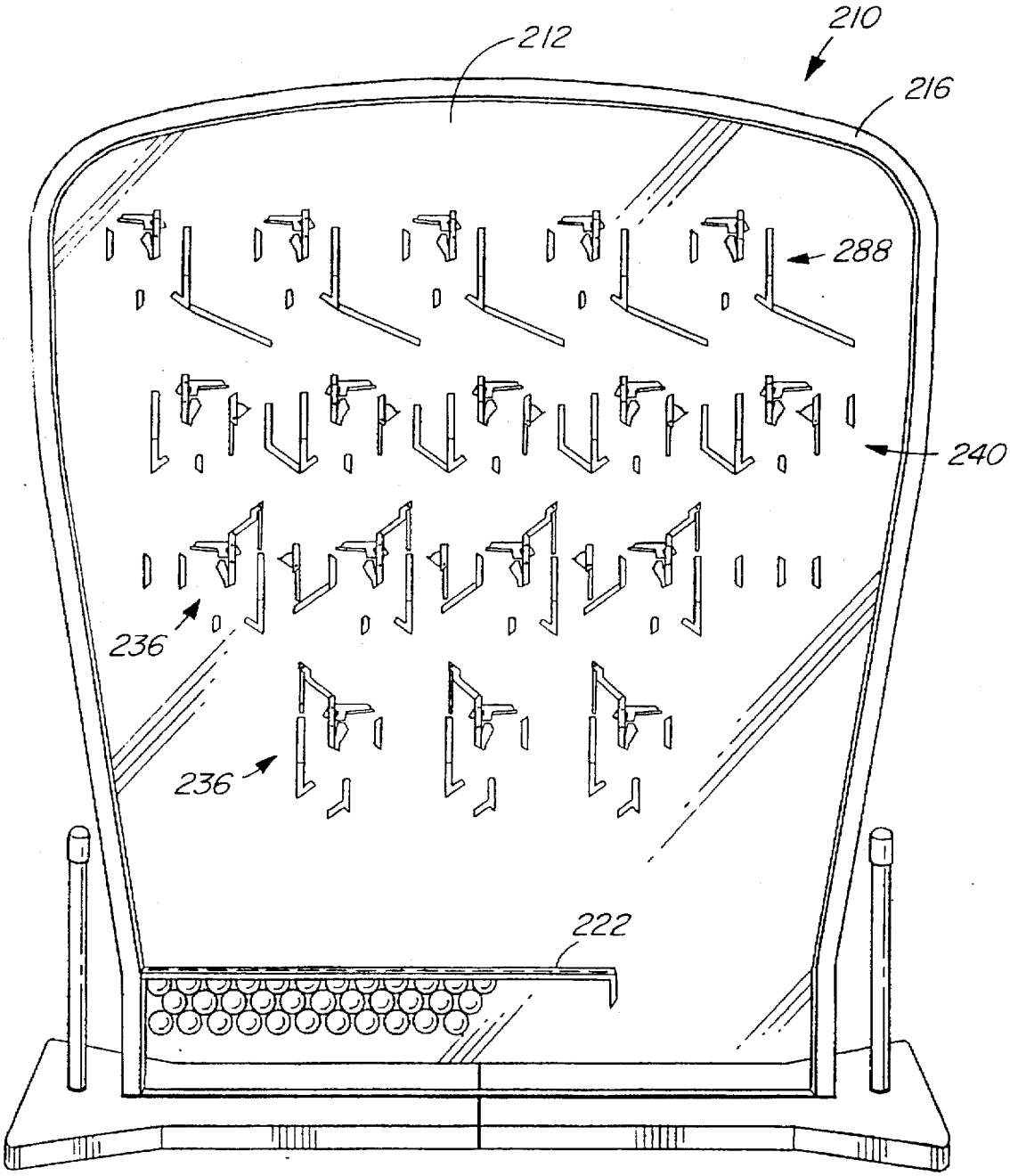
FIG. 8 shows a view in front elevation of a game according to a third embodiment of the invention.

FIG. 8 shows a further modification of the games of FIGS. 1 and 4, in which parts corresponding to those shown in FIGS. 1 and 4 are, for convenience, indicated by corresponding reference numerals in the two hundred series.

Figure 14:
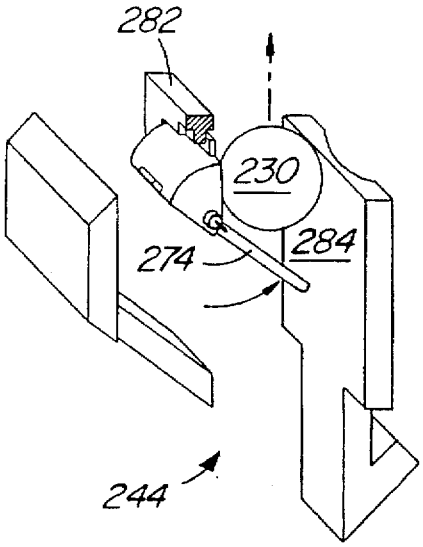

The game of FIG. 8, which is indicated generally by reference numeral 210, has a frame 216 securing together two vertical, parallel, mutually-spaced transparent walls, of which one is indicated by reference numeral 212. The wall 216 forming a liquid-tight seal around the space thus formed between the walls 212 for retaining a liquid in that space. A plurality of balls 230, which are similar to the balls 30 and which are described in greater detail below with reference to FIG. 14, are releasably secured beneath a retainer 222, which is similar to the retainers 22 and 122.

The game 210 also has two lowermost rows of retainers indicated generally by reference numerals 236, which are similar to the retainers 136 of FIG. 4, and an upper row of retainers 288, which are similar to the retainers 188 of FIG. 4. In addition, the game 210 has a third row of retainers, indicated generally by reference numeral 240, between the receptacles 236 and 288.

Figure 10:
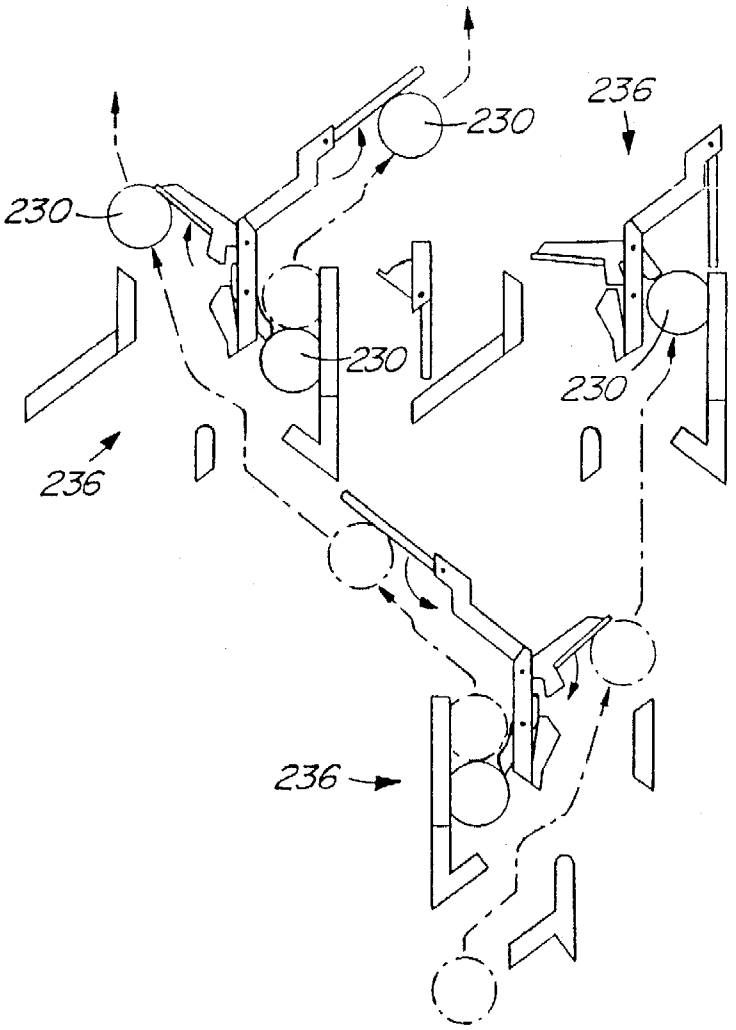
FIGS. 9 and 10 show views in front elevation of components of the game of FIG. 8 in two different stages of operation.
Figure 9:
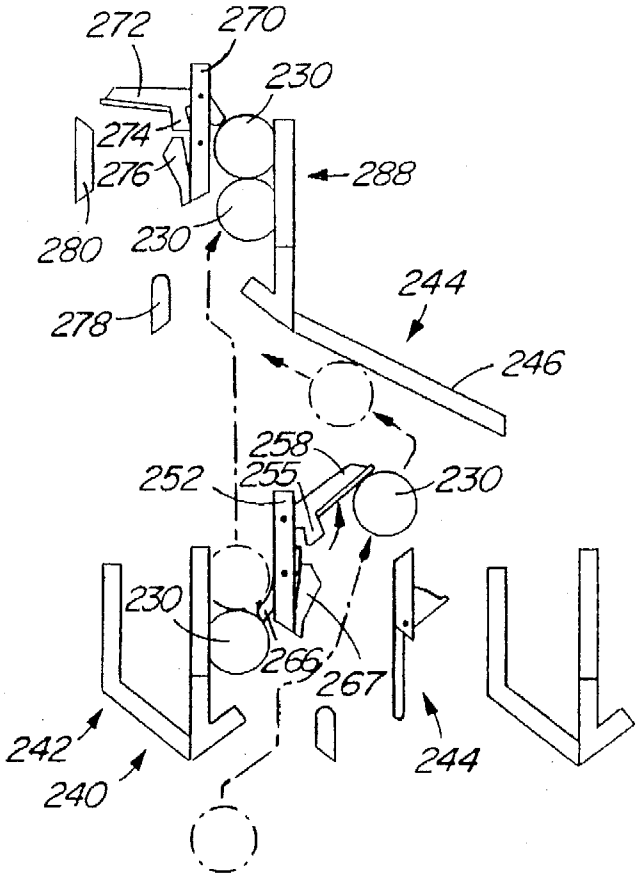

The operation of the receptacles 236 is illustrated in FIGS. 9 and 10, in which the possible upward paths of balls 230 are again indicated by chain-dot lines L. FIG. 9 shows one of the receptacles 240, with an overlying one of the receptacles 288. The receptacle 240 is provided with a double-armed ball guide 242, which replaces the ball guide 150 of the receptacle 136 of FIG. 5, and with a pivotable ball deflector indicated generally by reference numeral 244, which is described in greater detail below with reference to FIGS. 11 through 14. The receptacle 240 includes a ball guide 252 provided with a pivotable trip arm 258 with a projection 255 for pivoting a catch 266 from an abutment 267.

As shown in FIG. 9, the receptacle 288 is provided with a ball guide indicated generally by reference numeral 244, which has a downwardly angled arm 246 for deflecting balls from an underlying trip arm 258 of the receptacle 240 into the receptacle 288, as indicated by the chain-dot lines in FIG. 9.

The ball guide 244 co-operates with a ball guide 270 having a pivotable trip arm 272 provided with a projection 274 which normally rests under gravity on an abutment 276. Further ball guides 278 and 280 deflect the balls to the ball guide 270 and the trip arm 272, respectively.

FIG. 10 shows one of the receptacles 236 of the lowermost row cooperating with two receptacles 236 of the next-overlying row of receptacles. As indicated by the chain-dot lines in FIG. 10, the lowermost receptacle 236 may deflect the balls to the left or to the right, in a manner similar to that described above with reference to FIGS. 5 to 7, and likewise the receptacles 236 of the next row of receptacles may also each deflect the balls to the left or the right in a similar manner. It will be apparent, therefore, that there are various paths of upward movement for the balls to follow through the successive rows of receptacles, and these paths of movement are made more complicated by the number of rows and, also, by the number of balls which have been previously been released for upward movement during any particular game.

The construction and operation of the ball deflector 244 is illustrated in FIGS. 11 through 14, which shows one of the ball deflectors 244 of the uppermost of the two rows of receptacles 236 shown in FIG. 8.

The pivotable ball deflector 244 has a ball deflector arm 274 depending from a counterweight 276, the arm 274 and the counterweight 276 being freely pivotable about a pivot 278 through an arc which is limited by abutment of projections 280 mad 281 on the counterweight 276 against a stationary stop 282. The arm 274 cooperates with stationary ball guides 284 and 286 for deflecting the balls.

Figure 11:
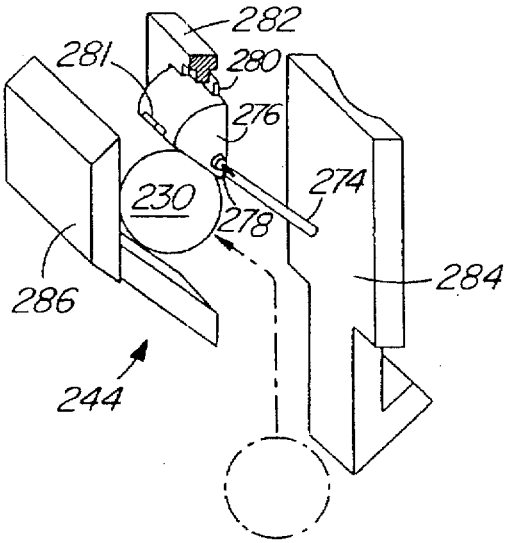
FIGS. 11 through 14 show views in perspective of components of the game of FIG. 8 in four different stages of operation.
Figure 12:
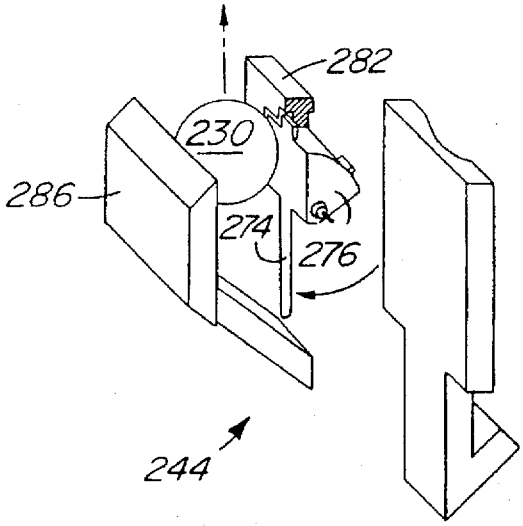
Figure 13:
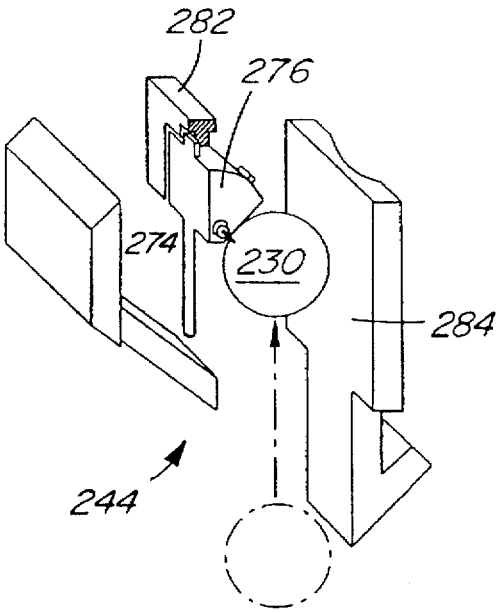

More particularly, and as shown in FIG. 11, if the arm 274 is initially directed towards the ball guide 284 as shown in FIG. 11, then an upwardly incoming ball is deflected to the left. As this ball rises between the counterweight 276 and the ball guide 286, it causes the counterweight 276 and, therewith, the arm 274 to pivot into the position shown in FIG. 12. Consequently, the next upwardly incoming ball 230, as shown in FIG. 13, is deflected to the right, along the ball guide 284, past the counterweight 276 and, thus, deflects the counterweight 276 and the arm 274 back into the position in which they are shown in FIG. 11. In this way, successive incoming balls are deflected to opposite sides of the stationary stop 282.

Figure 15:
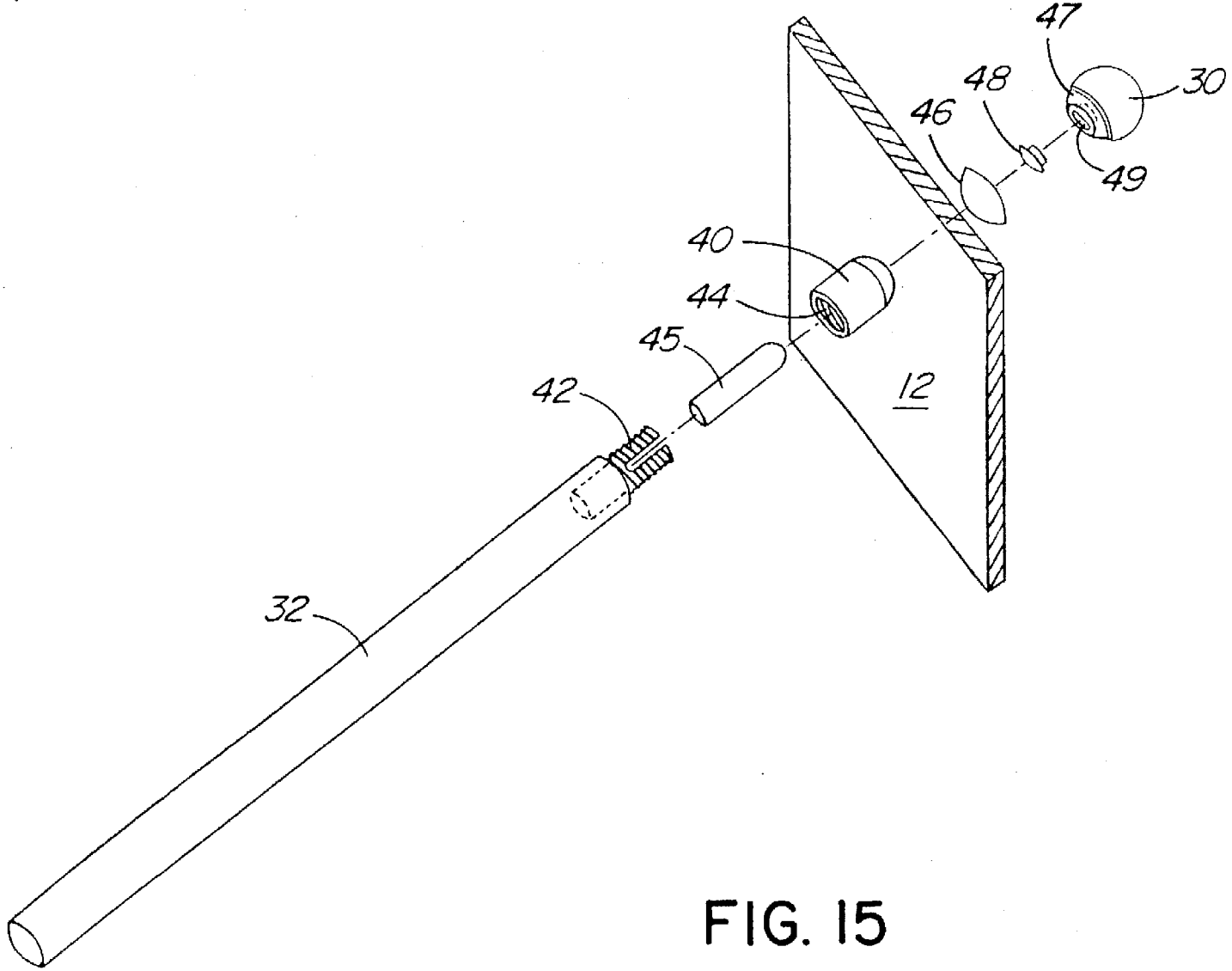
FIG. 15 shows a view in perspective of a wand and other components of the games of FIGS. 1, 4 and 8.

FIG. 15 shows in greater detail the construction of one of the wands 32 and one of the balls 30 of the game of FIG. 1, and it is to be understood that similarly constructed wands and balls are employed in the games of FIGS. 4 and 8.

As shown in FIG. 15, the wand 32 has a hollow tip 40, which is releasably secured to the wand 32 by means of a threaded cylindrical portion 42 of the wand 32, which is threadably engageable with an internal thread 44 in the tip 40. A plug 45 of magnetic material is contained within the tip 40 and the threaded portion 42.

The ball 30 has a separately-formed, spherically-curved cap 46 which fits into a correspondingly shaped recess 47 in the ball 30 and which serves to retain a stud-shaped insert 48 of ferromagnetic material in a recess 49 in the ball 30. The cap 46 is secured to the ball 30 by an adhesive (not shown) and thus serves to encapsulate the insert 48 in a liquid-tight manner, so that the insert 48 is protected from rusting when the liquid is water.

Figure 16:
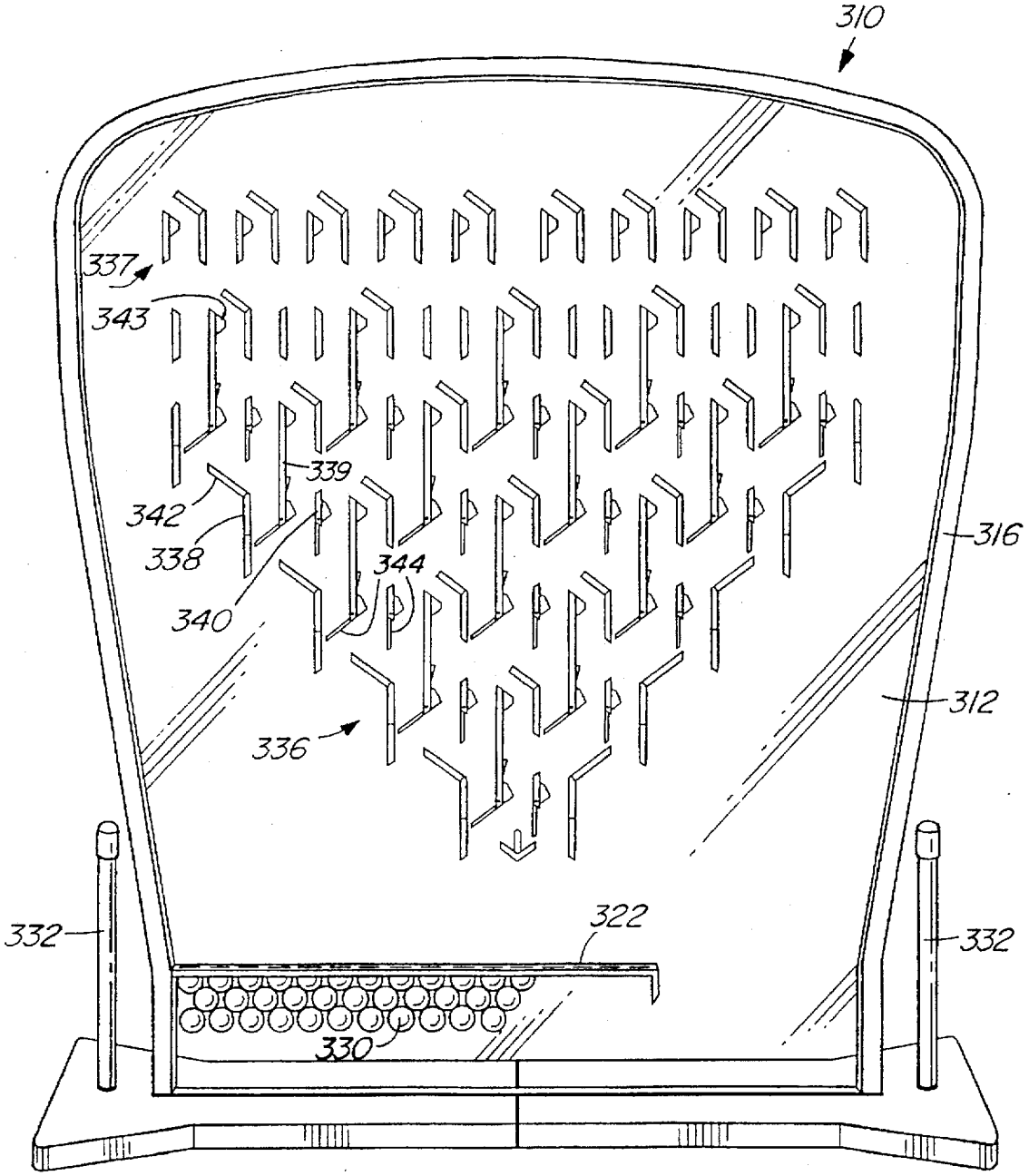
FIG. 16 shows a view in front elevation of a game according to a fourth embodiment of the invention.

FIG. 16 shows a further modification of the game, indicated generally by reference numeral 310, which has a frame indicated generally by reference numeral 316, corresponding to the frame 16 of FIG. 1, securing together parallel transparent walls, one of which is indicated by reference numeral 312, containing a liquid with a ball retainer 322 and balls 330 and provided with wands 332. Since these components are similar to the corresponding components of the game 10, they are not described in further detail.

However, the game 310 has receptacles 336 defined by horizontal rows of ball guides, with an upper row of receptacles 337.

The receptacles 336 each comprise three vertical ball guides 338, 339 and 340. The ball guides 338 are foraged with upwardly and laterally inclined rows 342. The ball guides 339 are provided, at their tops, with lateral ball retaining projections 343, and the ball guides 339 and 340 each have at their bottoms, ball deflectors comprising pivotable trip arms 344 which are provided with counterweights in a form which is similar to that of the ball deflector 244 of FIGS. 11 through 14 and which is therefore not further described.

In use, the pivotable ball deflectors 344 determine whether the rising balls reach the upper row of receptacles 337, to thereby score, by deflecting the balls left or right to one of the overlying receptacles or whether the balls are retained in the receptacles 336 by the projections 343. The receptacles 336 are dimensioned so that two balls, at the most, can be retained by each projection 343.

The various ball receptacles and ball guides of the above-described embodiments are fixedly secured by adhesive (not shown) to one of the transparent walls.

As will be apparent to those skilled in the art, various modifications may be made to the above-described embodiment within the scope and spirit of the appended claims.

What is claimed is:

1. A game comprising:

a pair of walls extending parallel to one another and defining a space therebetween;

at least one of said walls being transparent to permit viewing of said space from the exterior of the game;

a liquid-tight seal extending around the peripheries of said walls and sealingly enclosing said space;

a liquid retained in said space by said seal;

a plurality of balls immersed in said liquid, said balls being buoyant in said liquid and comprising a ferromagnetic material;

a retainer for releasably retaining said balls;

a magnet at the exterior of said space, said magnet being manipulatable for displacing said balls from said retainer; and a plurality of mutually spaced-apart ball receptacles located in said space;

said receptacles each having a downwardly facing ball reception opening dimensioned to receive said balls therein as said balls rise buoyantly through said space on release of said balls by said magnet.

2. A game as claimed in claim 1, wherein said receptacles are in rows in which said receptacles are spaced apart horizontally from one another by gaps, and wherein the receptacles of each row, other than a lowermost one of said rows, are disposed vertically above the gaps of an underlying one of said rows.

3. A game as claimed in claim 1, wherein said receptacles are each dimensioned to accommodate a pair of balls in the respective ball reception opening with an uppermost one of said pair on a lowermost one of said pair and with the lowermost one protruding downwardly from said opening sufficiently to deflect any other ball past the exterior of the respective receptacle.

4. A game as claimed in claim 1, wherein said receptacles each comprise a pair of generally vertically extending elongate members which are spaced apart laterally of one another.

5. A game as claimed in claim 1, wherein said retainer comprises an elongate horizontal member extending partially across a lower portion of said space.

6. A game as claimed in claim 1, wherein said receptacles each comprise a first ball guide which is vertically elongate and fixed in position, a second ball guide which is spaced laterally of said first ball guide, said second ball guide being provided with a catch extending towards said first ball guide for releasably retaining one of said balls beneath said catch in the respective ball reception opening, and a pivot supporting said catch and said second ball guide further comprising a pivotable trip arm projecting laterally therefrom in a direction away from said first ball guide for causing pivotation of said catch, by engagement with said catch, to release said one of said balls from said ball reception opening in response to rising of another of said balls into contact with said trip arm.

7. A game as claimed in claim 6, wherein said second ball guide comprises a ball guide arm extending upwardly over the respective ball reception opening for guiding said one of said balls on its release thereof from the respective ball reception opening.

8. A game as claimed in claim 7, wherein said second ball guide includes an elongate ball deflector, depending from said ball guide arm, a deflector pivot connecting said ball deflector to an upper end of said ball guide arm and an abutment limiting pivotation of said ball deflector about said deflector pivot.

9. A ball game as claimed in claim 6, further comprising a further ball guide spaced laterally of said second ball guide for deflecting balls rising therebetween towards said trip arm.

10. A game as claimed in claim 1, further comprising pivotable ball deflector arms associated with said ball receptacles, said pivotable ball deflector arms each being located between a pair of stationary ball guides, a pivot supporting said ball deflector arm for pivotation between said ball guides for deflecting an upwardly rising one of said balls along one of said ball guides in a first position of pivotation of said ball deflector arm and along the other of said ball guides in a second position of pivotation of said ball deflector arm, and a counterweight on said ball deflector arm.

11. A game as claimed in claim 6, further comprising a pivotable ball deflector arms associated with said ball receptacles, said pivotable ball deflector arms each being located between a pair of stationary ball guides, and having a pivot supporting said ball deflector arm for pivotation between said ball guides for deflecting an upwardly rising one of said balls along one of said ball guides in a first position of pivotation of said ball deflector arm and along the other of said ball guides in a second position of pivotation of said ball deflector arm, and a counterweight on said ball deflector arm.

12. A game as claimed in claim 1, further comprising a base secured to said walls for supporting said walls in a vertical position, and means for releasably securing said base to said walls.

13. A game as claimed in claim 1, wherein said balls comprise a first set of one color and a second set of another color to allow two competitors to play the game.

14. A game as claimed in claim 1, wherein the receptacles each comprise a pair of mutually spaced vertically extending ball guide members, and wherein same of said ball guide members are formed with lateral projections for retaining the balls in the respective receptacles and others of said receptacles are provided with counterweighted pivotable ball deflectors for deflecting the balls into overlying ones of said receptacles.

* * * * *